US008146746B2

(12) United States Patent
Apps

(10) Patent No.: US 8,146,746 B2
(45) Date of Patent: Apr. 3, 2012

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 125 days.

(21) Appl. No.: 12/752,273

(22) Filed: Apr. 1, 2010

(65) Prior Publication Data

US 2010/0258469 A1 Oct. 14, 2010

Related U.S. Application Data

(60) Provisional application No. 61/167,776, filed on Apr. 8, 2009.

(51) Int. Cl.
*B65D 21/032* (2006.01)

(52) U.S. Cl. ..... 206/509; 220/516

(58) Field of Classification Search ..... 206/505, 206/507, 509, 519; 220/516
See application file for complete search history.

(56) References Cited

U.S. PATENT DOCUMENTS

| | | | | |
|---|---|---|---|---|
| 5,660,279 | A * | 8/1997 | Apps et al. | 206/503 |
| 2003/0029870 | A1 | 2/2003 | Apps et al. | |
| 2006/0169620 | A1 * | 8/2006 | Apps | 206/509 |

FOREIGN PATENT DOCUMENTS

| | | | |
|---|---|---|---|
| WO | 00/75027 | A1 | 12/2000 |
| WO | 02/083512 | A1 | 10/2002 |

OTHER PUBLICATIONS

Photograph of Pepsi—Blue Crate, Top View.
Photograph of Pepsi—Blue Crate, Bottom View 1.
Photograph of Pepsi—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate; Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.
European Search Report for EP Application No. 10159323.4, Aug. 3, 2010.

* cited by examiner

*Primary Examiner* — Harry Grosso
(74) *Attorney, Agent, or Firm* — Carlson, Gaskey & Olds

(57) ABSTRACT

A tray for storing and transporting bottles according to one embodiment of the present invention includes a base and a plurality of corner columns and side columns extending upwardly from the base, including center side columns. The center side columns and the corner columns having outer ledges defining a nesting height of the tray, such that the side walls of a similar tray nested thereon would contact and rest on the outer ledges of the center side columns and the corner columns. According to another, independent feature of the present invention, the noncenter side columns are offset inwardly relative to adjacent columns. This accommodates the handle of the tray in a ninety-degree cross-stacked configuration. As another optional feature, end columns are offset inwardly relative to adjacent corner columns in order to accommodate the handle of a similar tray nested thereon.

19 Claims, 11 Drawing Sheets

STACKABLE LOW DEPTH TRAY

This application claims priority to U.S. Provisional Application Ser. No. 61/167,776, filed Apr. 8, 2009.

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays having side walls, end walls and dividers defining pockets between the side walls and end walls. There are many known tray designs that are referred to as "low depth" trays in which the side walls, end walls and dividers are lower than the height of the stored bottles, and in which the bottles support the weight of additional trays and bottles stacked thereon.

One known type of low-depth tray had sidewalls and dividers all at the same height. In later versions of this tray, a portion of the dividers was lowered to reduce weight. This height of the side walls and dividers was the nest stop for empty crates stacked thereon in both a column (i.e. trays aligned) and cross stack (i.e. each row of trays is ninety degrees relative to the row of trays below it, or the trays are longitudinally aligned and longitudinally offset by 50%).

In the known trays, the bottom ribs of the tray base extend down approximately 0.1" further than the sidewall. Raising the bottom edge of the sidewalls in this manner makes it easier for a delivery person to get a hand truck blade under a stack of crates to move them. As a result, the sidewalls of stacked empty crates do not rest on each other. It is the bottom ribs extending down from the base that rest on top of the dividers when stacked. One problem with this raised side wall design is that empty stacks are not as stable because the footprint is much smaller stacking on dividers only.

Later generation trays improved on this design by adding ribs on the outside of the walls to capture the sidewall of the crate above and also widening the lower part of the castle to capture the bottom ribs of the crate above.

In another tray, the side walls between the columns and the dividers are lowered for more visibility. As a result, the side walls do stack on the top of the side walls of the tray below. In this design, the columns are taller in order to better support bottles with a portion of reduced diameter between the base and a mid-portion of the bottle. One problem with this design is that the taller columns extend into the handle area of the tray above, in both a column stack and a cross stack position. In order to accommodate the handle, the columns are aggressively tapered on the outside face of the columns on the perimeter of the tray. However, the center columns still do not accommodate the handle in a longitudinal cross-stack arrangement. Also, this design results in corner columns that are more fragile because they include the aggressive taper on two sides.

SUMMARY OF THE INVENTION

A tray for storing and transporting bottles according to one embodiment of the present invention includes a base and a plurality of interior columns extending upwardly from the base, including a center interior column. A plurality of side columns extend upwardly along sides of the tray, including two noncenter side columns and a center side column on each side of the tray, each center side column between the two noncenter side columns. Corner columns are at corners of the tray. The center side columns and the corner columns have outer ledges defining a nesting height of the tray, such that the side walls of a similar tray nested thereon would contact and rest on the outer ledges of the center side columns and the corner columns. The noncenter side columns do not include an outer ledge at the nesting height.

According to another, independent feature of the present invention, exterior surfaces of opposing noncenter side columns on opposite sides of the tray are spaced from one another by a distance less than that by which exterior surfaces at the first height of opposing center side columns on opposite sides of the tray. In other words, the noncenter side columns are offset inwardly relative to adjacent columns. This accommodates the handle of a tray stacked thereon in a ninety-degree cross-stacked configuration.

According to another, independent feature of the present invention, exterior surfaces of the end columns are offset inwardly relative to the respective adjacent corner columns. This accommodates the handle of a tray nested thereon in a column stack configuration.

According to another, independent feature of the present invention, the center interior column and the center side columns include spaced apart halves, defining a passage therethrough. The halves of the center interior column are spaced further apart than the halves of the center side columns in order to accommodate the handle cross-stacked longitudinally thereon.

These and other features of the application can be best understood from the following specification and drawings, the following of which is a brief description.

DETAILED DESCRIPTION OF THE PREFERRED EMBODIMENT

Figure 1:
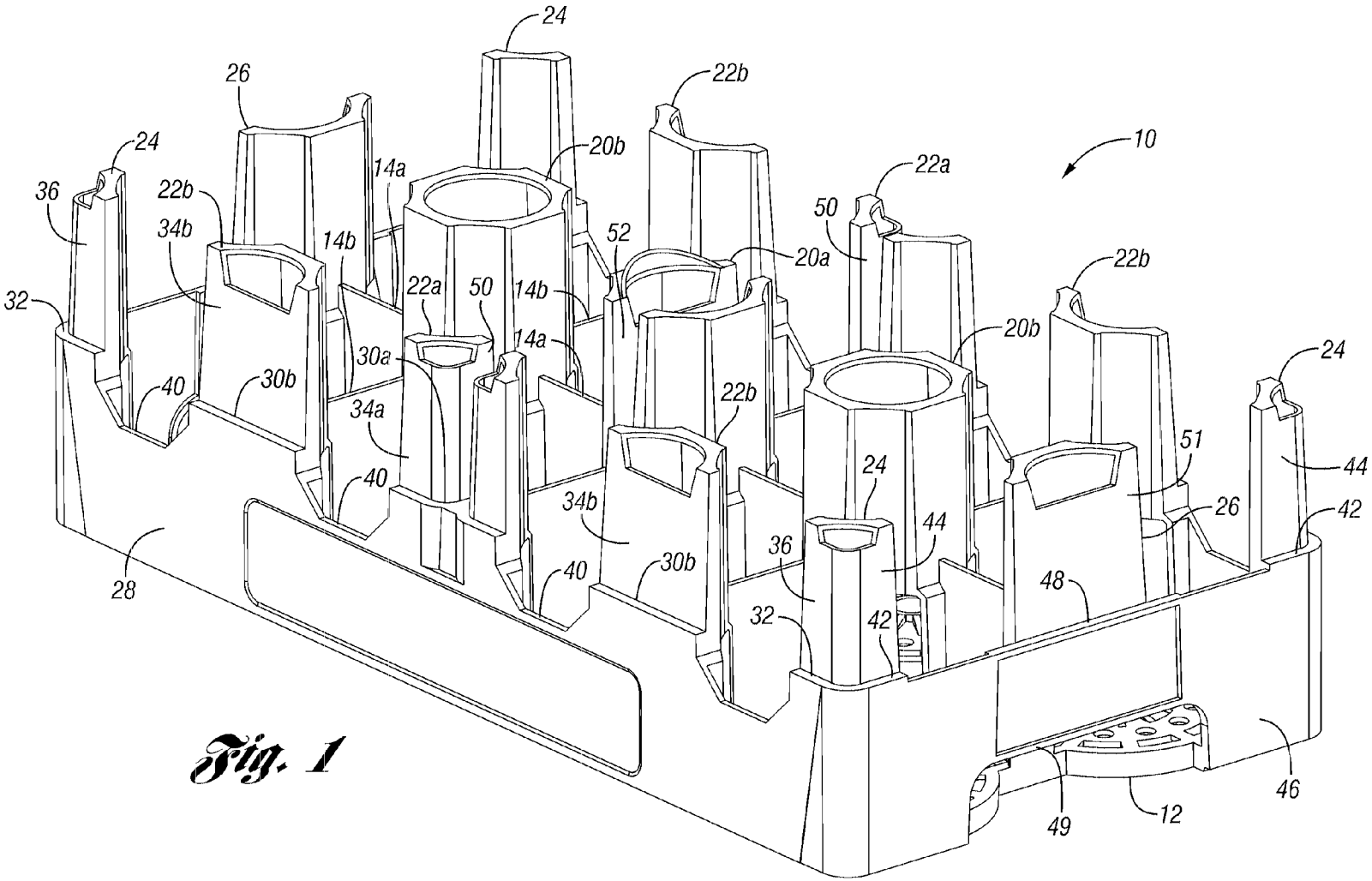
FIG. 1 is a perspective view of a tray according to one embodiment of the present invention.

A tray 10 according to one embodiment of the present invention is shown in FIG. 1. The tray 10 includes a base wall 12. A plurality of longitudinal dividers 14*a* and a plurality of lateral dividers 14*b* (or, together "dividers 14") extend outward from a plurality of interior columns 20*a*, 20*b* which, together with the base walls 12, longitudinal dividers 14*a* and lateral dividers 14*b* define a plurality of bottle receiving pockets. The interior columns include a center interior column 20*a* and two noncenter interior columns 20*b* arranged generally along a longitudinal centerline of the tray 10.

The lateral dividers 14*b* each connect one of the interior columns 20 with one of a plurality of side columns 22*a*, 22*b* positioned along a side edge of the tray 10. The side columns 22*a*, 22*b* (collectively "side columns 22") center side columns 22*a* and noncenter side columns 22*b*. The tray 10 further includes four corner columns 24 extending upwardly from the corners of the tray 10. End columns 26 extend upwardly from ends of the tray 10, between the corner columns 24.

Side walls 28 on each side of the tray 10 define outer ledges 30*a*, 30*b* adjacent the center side columns 22*a* and noncenter side columns 22*b*, respectively. The side walls 28 further define outer ledges 32 adjacent the corner columns 24. Exterior surfaces 34*b* of the noncenter side columns 22*b* adjacent the outer ledges 30*b* are offset inwardly relative to the exterior surfaces 34*a* of the center side columns 22*a* adjacent the outer ledges 30*a* and relative to the exterior surfaces 36 of the corner columns 24 adjacent the outer ledges 32. The outer ledges 30*a* of the center side columns 22*a* and the outer ledges 32 of the corner columns 24 define the nesting height, and the outer ledges 30*b* of the noncenter side columns 22*b* are slightly lower than the nesting height. Alternatively, the outer ledges 30*b* of the noncenter side columns 22*b* could be eliminated.

At the ends of the tray 10, an end wall 46 defines outer ledges 42 at the nesting height adjacent exterior surfaces 44 of the corner columns 24. The end wall 46 also defines an outer ledge 48 below the nesting height adjacent an exterior surface 51 of the end column 26. The exterior surface 51 of the end column 26 is offset inwardly relative the exterior surfaces 44 of the corner columns 24. A handle 49 is defined by a downwardly open recess formed in the end wall 46 below the end column 26.

Figure 2:
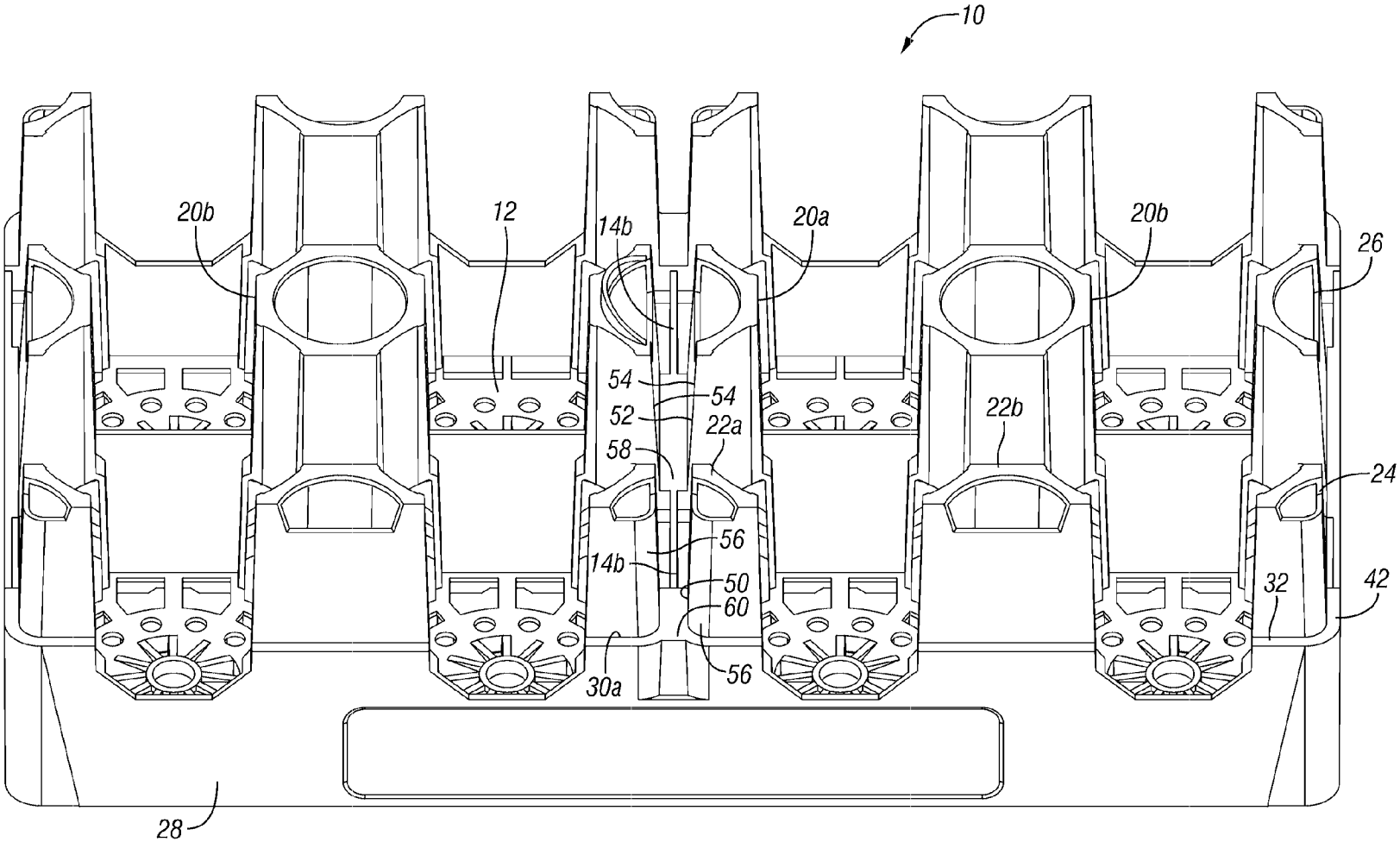
FIG. 2 is a side perspective view of the tray.

The center side columns 22*a* are split to define a lateral passage 50 therethrough, which is aligned with a lateral passage 52 through the center interior column 20*a*. As shown in FIG. 2, the lateral passage 52 through the center interior column 20*a* is wider than the lateral passage 50 through the center side columns 22*a*, such that the interior surfaces 54 of the center interior column 20*a* are offset away from center relative to the interior surfaces 56 of the center side columns 22*a*. The lateral divider 14*b* aligned with the center interior column 20*a* is at the same height as a lower surface 58 of the lateral passage 52 through the center interior column 20*a*, which is below the nesting height. The lower surface 60 of the lateral passage 50 through the center side columns 22*a* is at the nesting height, continuous with the outer ledges 30*a* of the center side columns 22*a*.

As a result, only the outer ledges 30*a* and lower surface 60 of the lateral passage 50 of the center side columns 22*a* and the outer ledges 32, 42 of the corner columns 24 are at the nesting height. Considering the tray 10 as two sets of 2×2 pockets, this creates nesting stops only at the four corners of each of the sets of four pockets. This provides stable, consistent nesting in a column stack and in cross-stack (longitudinal or lateral).

Further, within each set of 2×2 pockets, if one considers the split center interior column 20*a* and the center side columns 22*a* as two separate columns each, then the non-corner columns along the perimeter of each 2×2 set (i.e. end column 26, noncenter side columns 22*b*, and one half of the center interior column 20*a*) are each offset inwardly relative to its adjacent "corner columns" (now also considering the split center side columns 22*a* as "corners" within each 2×2 set). The offset end column 26 provides clearance for the handle 49 of a similar tray column stacked thereon. The offset noncenter side columns 22*b* provide clearance for the handle 49 of a similar tray cross-stacked laterally (i.e. 90 degrees) thereon. The offset halves of the center interior column 20*a* provide clearance for the handle 49 of a longitudinally cross-stacked similar tray.

Figure 3:
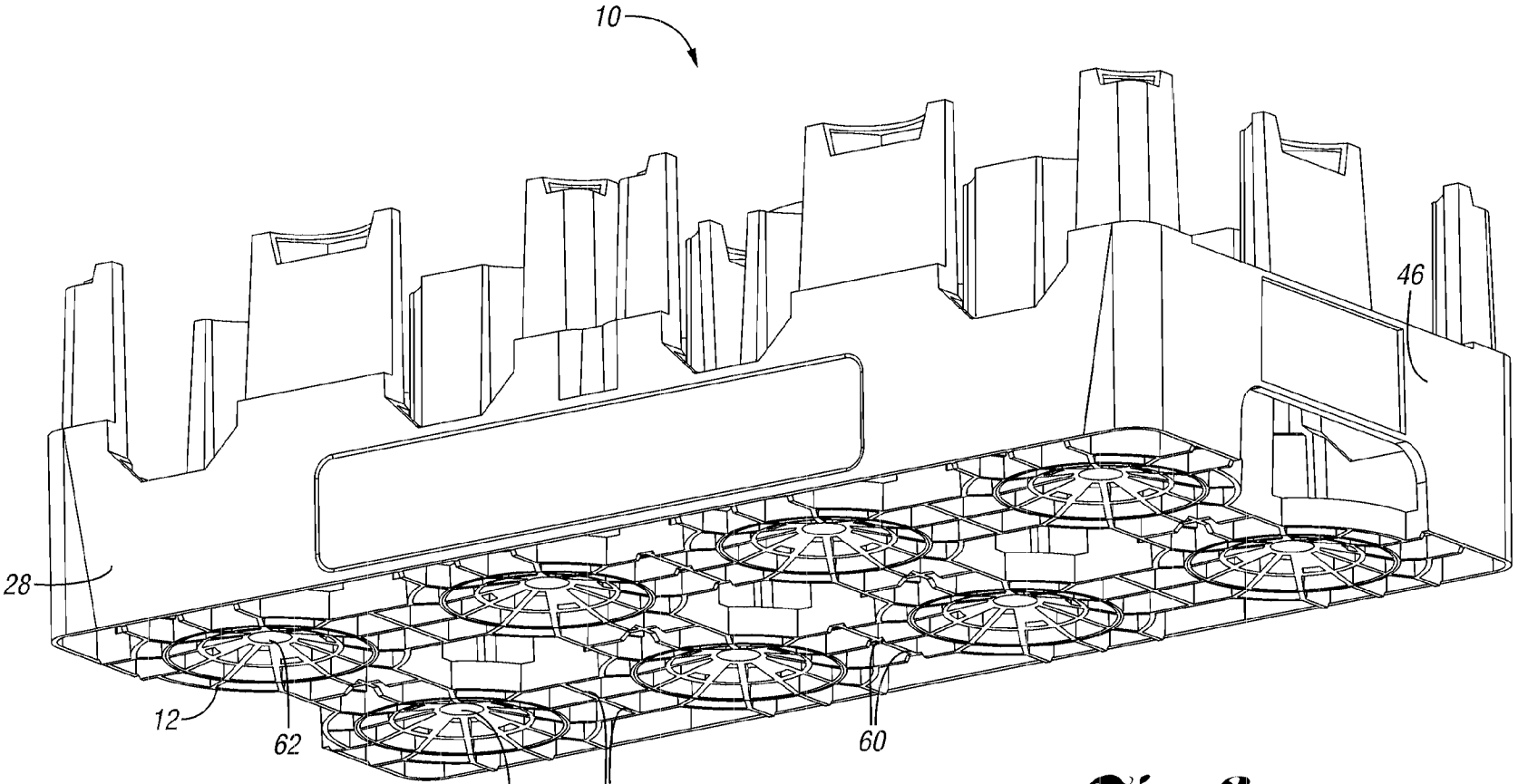
FIG. 3 is a bottom perspective view of the tray.
Figure 4:
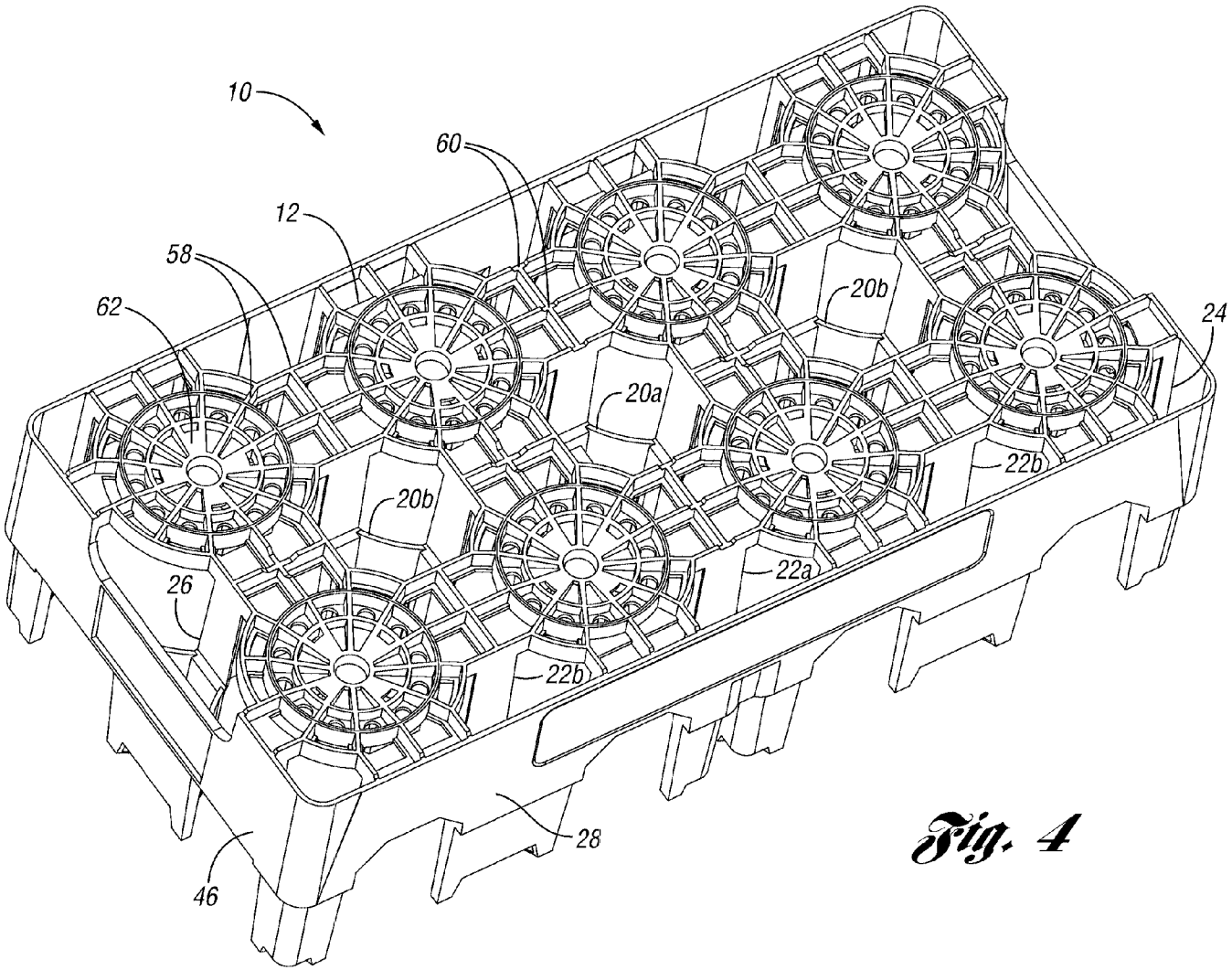
FIG. 4 is a bottom perspective view of the tray.

FIGS. 3 and 4 are bottom perspective views of the tray 10. The base 12 includes a plurality of interconnected ribs 58 generally defining the lowermost plane of the tray 10. The lowermost edge of the side walls 28 and end walls 46 are spaced slightly above the lowermost plane of the ribs 58. Additionally, a channel 60 is formed laterally through the center of the ribs 58 (i.e. aligned with the center lateral divider 14*b*) to provide another surface that is in the same plane as the lowermost edges of the side walls 28 and end walls 46. These are the bottom nesting surfaces of the tray 10, i.e. the surfaces that contact the nesting stop surfaces at the nesting height of the tray 10 nested below. Thus, these lower perimeter surfaces of the trays 10 support the trays 10 in any nesting configuration, rather than the ribs 58 which are spaced inwardly from the perimeter. This provides increased stability of the stacked trays 10. The ribs 58 also form cone-shaped bottle-cap receiving recesses 62, which receive the bottle-caps of bottles in a tray 10 stacked therebelow when the trays are loaded. The cone-shaped recesses 62 increase the stability of the stacked, loaded trays 10.

Figure 5:
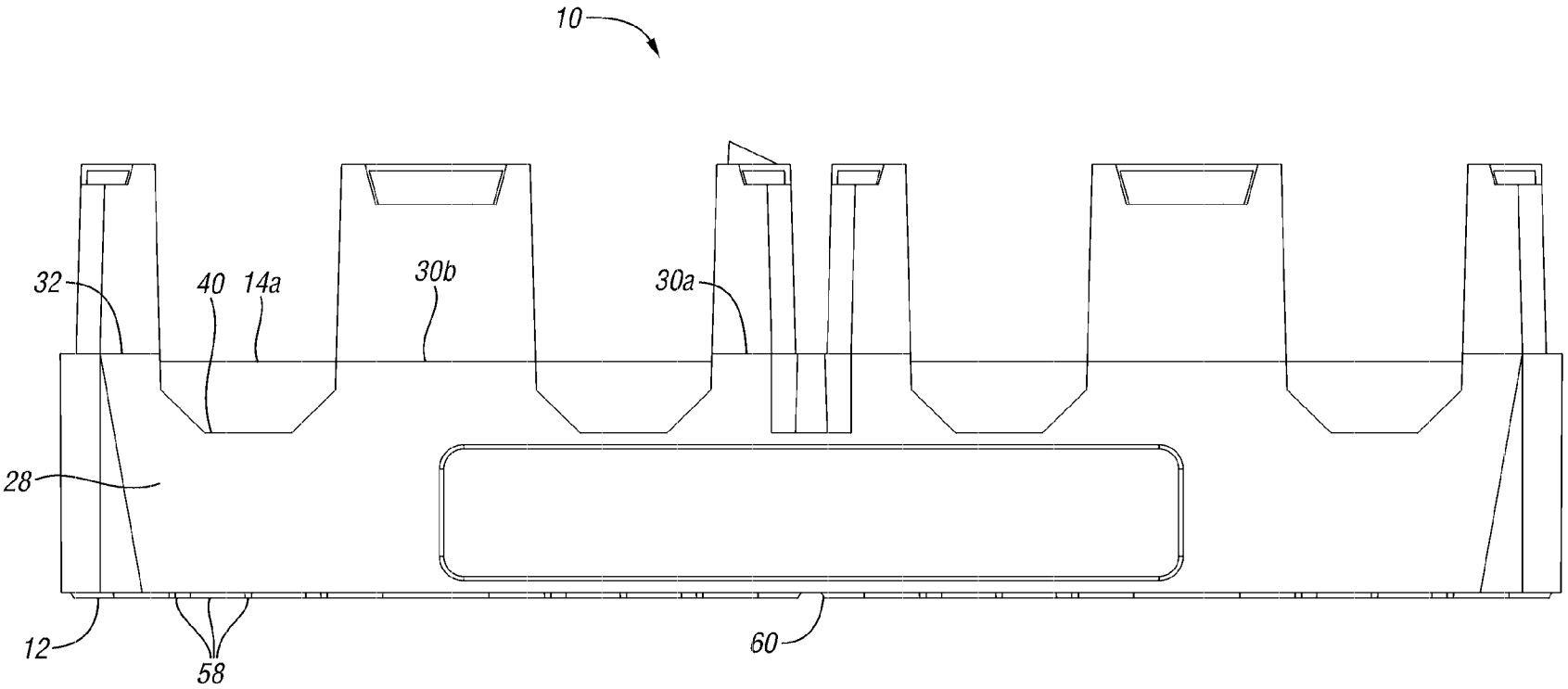
FIG. 5 is a side view of the tray.

FIG. 5 is a side view of the tray 10. Again, the outer ledges 30*a* and 32 are at the nesting height, while the outer ledges 30*b* and longitudinal dividers 14*a* (and lateral dividers 14*b*, FIG. 2) are spaced slightly below the nesting height. As a result, all of the contact with the upper tray 10 is only on the surfaces that are at the nesting height. Also, as shown, the ribs 58 of the base 12 extend downwardly slightly further than the side walls 28 (and end walls 46, FIG. 3). The channel 60 through the center of the base 12 provides another surface at the same height as the side walls 28 and end walls 46.

Figure 6:
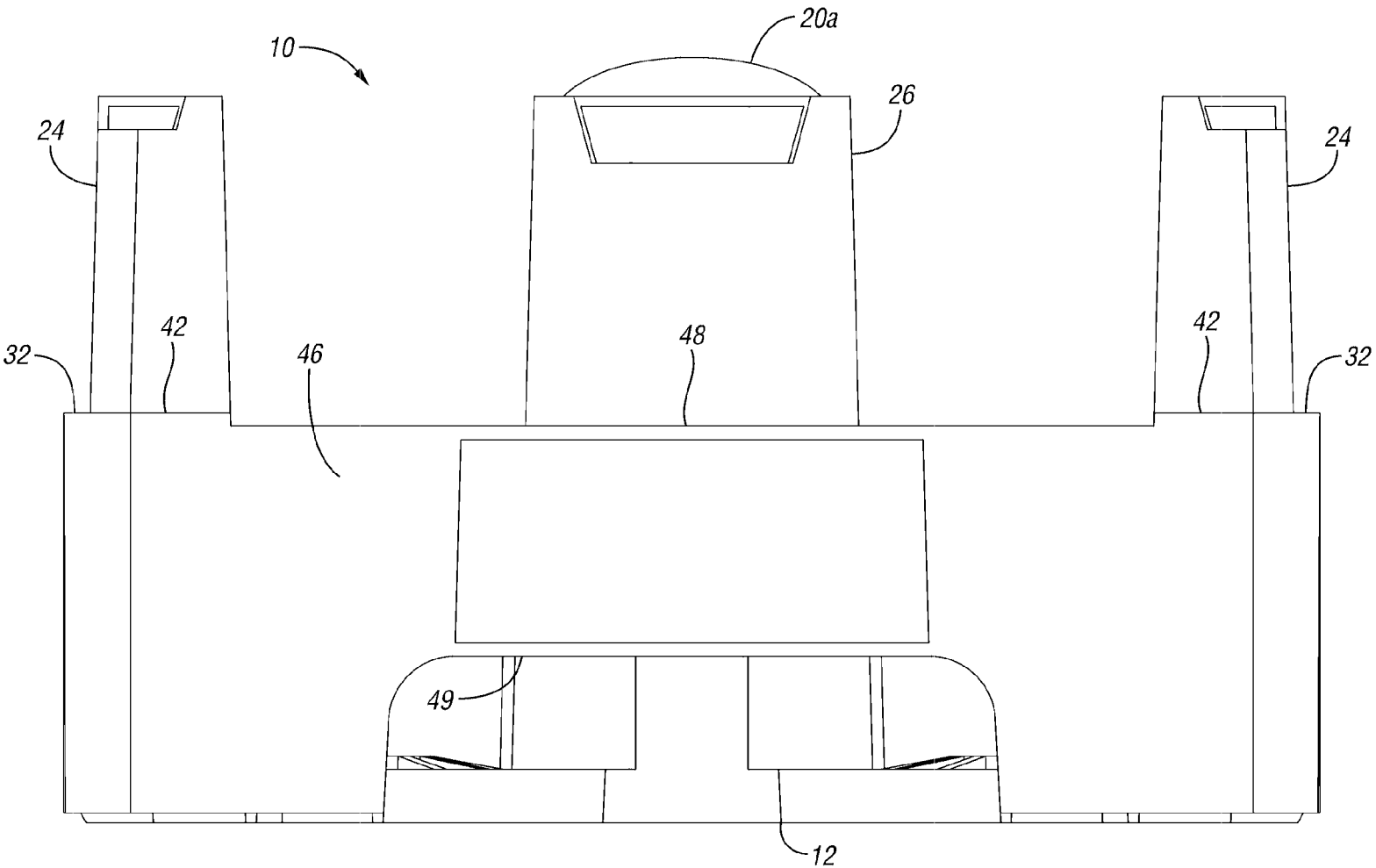
FIG. 6 is an end view of the tray.

FIG. 6 is an end view of the tray 10. As shown, the outer ledge 48 adjacent the end column 26 is slightly lower than the outer ledges 42, 32 of the corner columns 24, which are at the nesting height.

Figure 7:
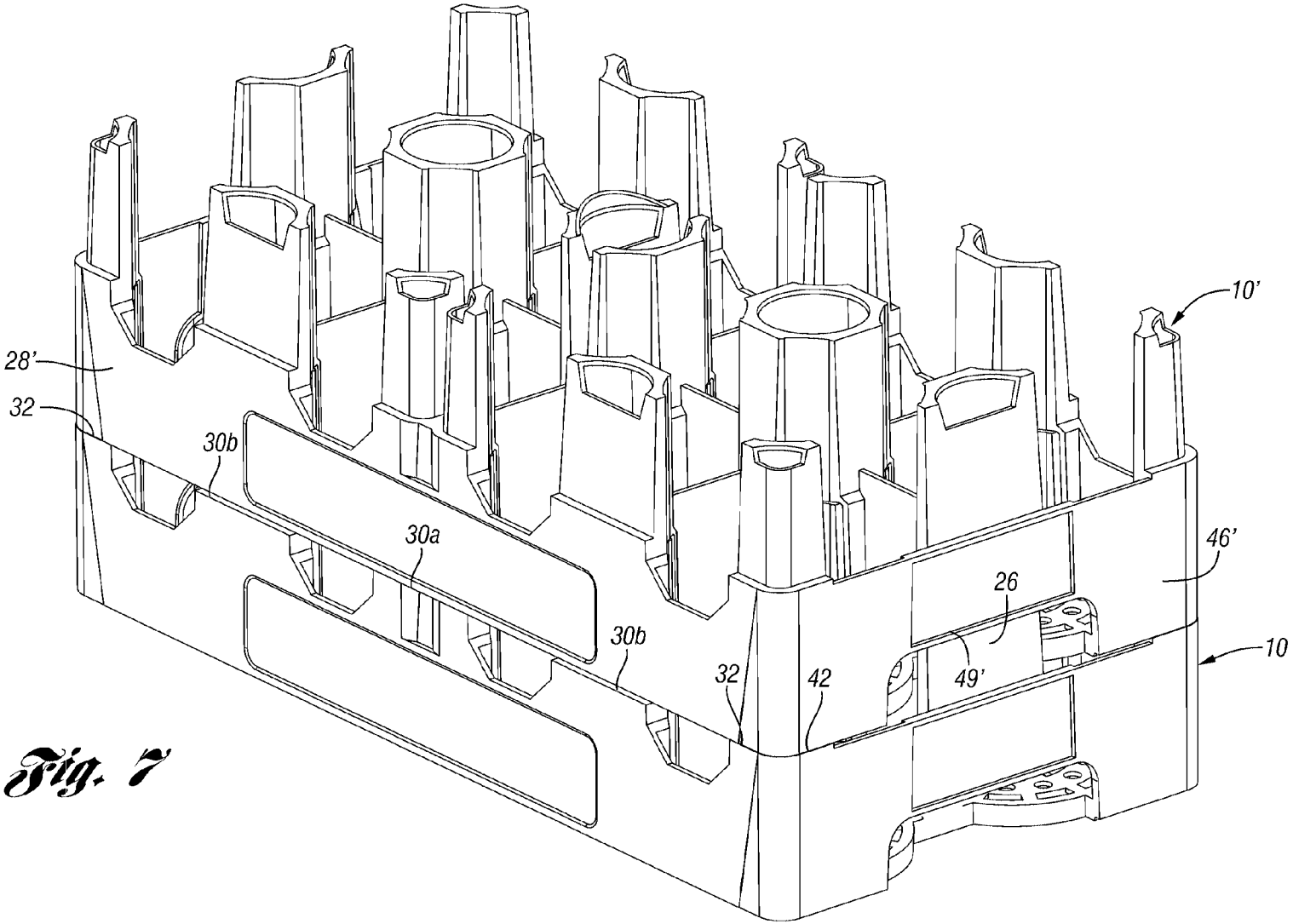
FIG. 7 is a perspective of the tray with a similar tray column stacked thereon.

FIG. 7 shows the tray 10 with a similar tray 10' column stacked thereon. The side walls 28' and end walls 46' rest on the outer ledges 30*a*, 32, 42 of the lower tray 10. The offset end column 26 of the lower tray 10 nests in the handle 49' of the upper tray 10'.

Figure 8:
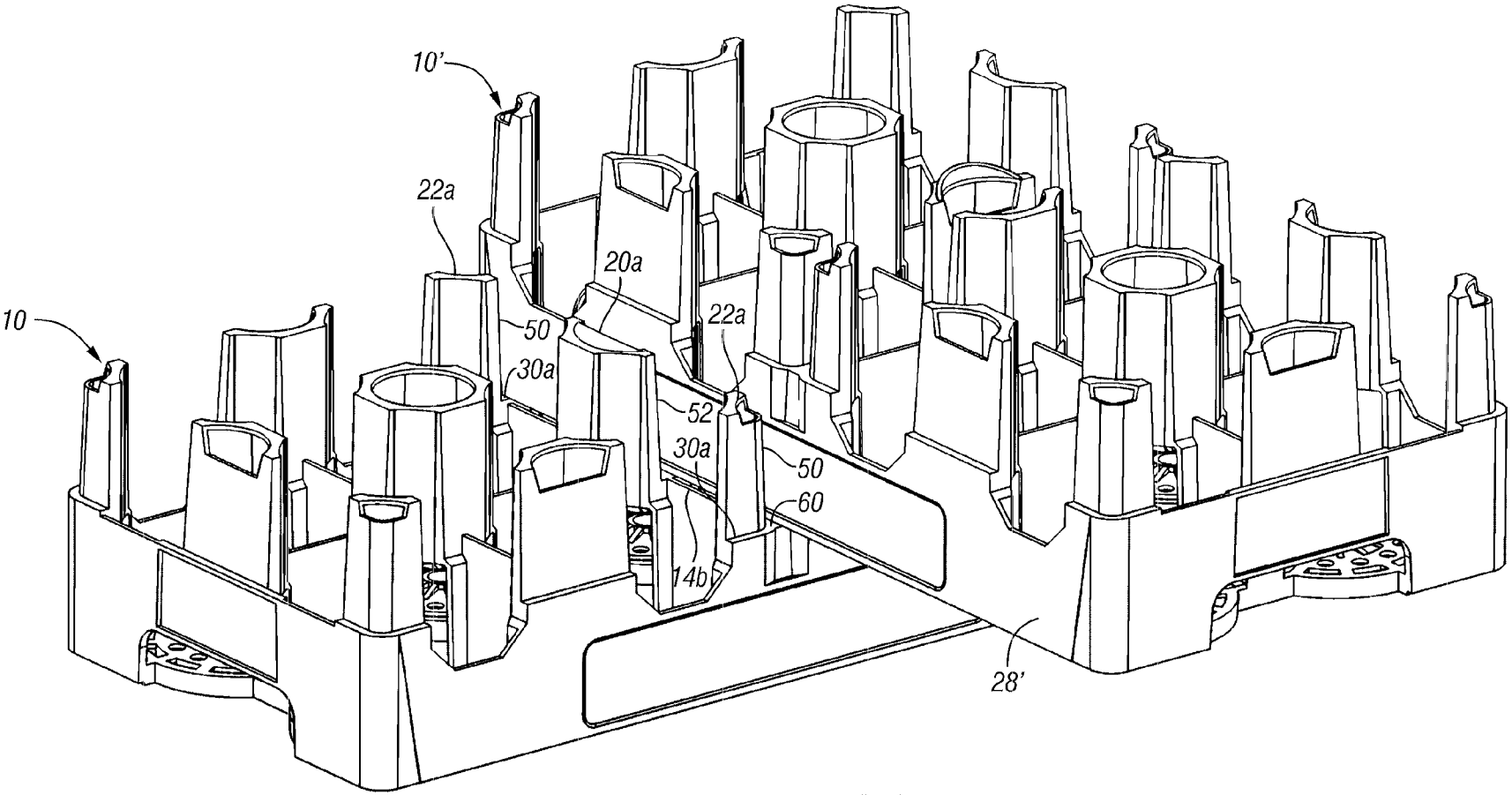
FIG. 8 is a perspective of the tray with the similar tray cross-stacked ninety degrees thereon.

FIG. 8 shows the tray 10 with the similar tray 10' cross stacked ninety degrees thereon. In this configuration, one side wall 28' of the upper tray 10' rests on the lower surfaces 60 of the passages 50 through the center side columns 22*a* of the lower tray 10. The other side wall 28', shown in FIG. 9, rests on the outer ledges 42 of the corner columns 24 of the lower tray 10.

Figure 9:
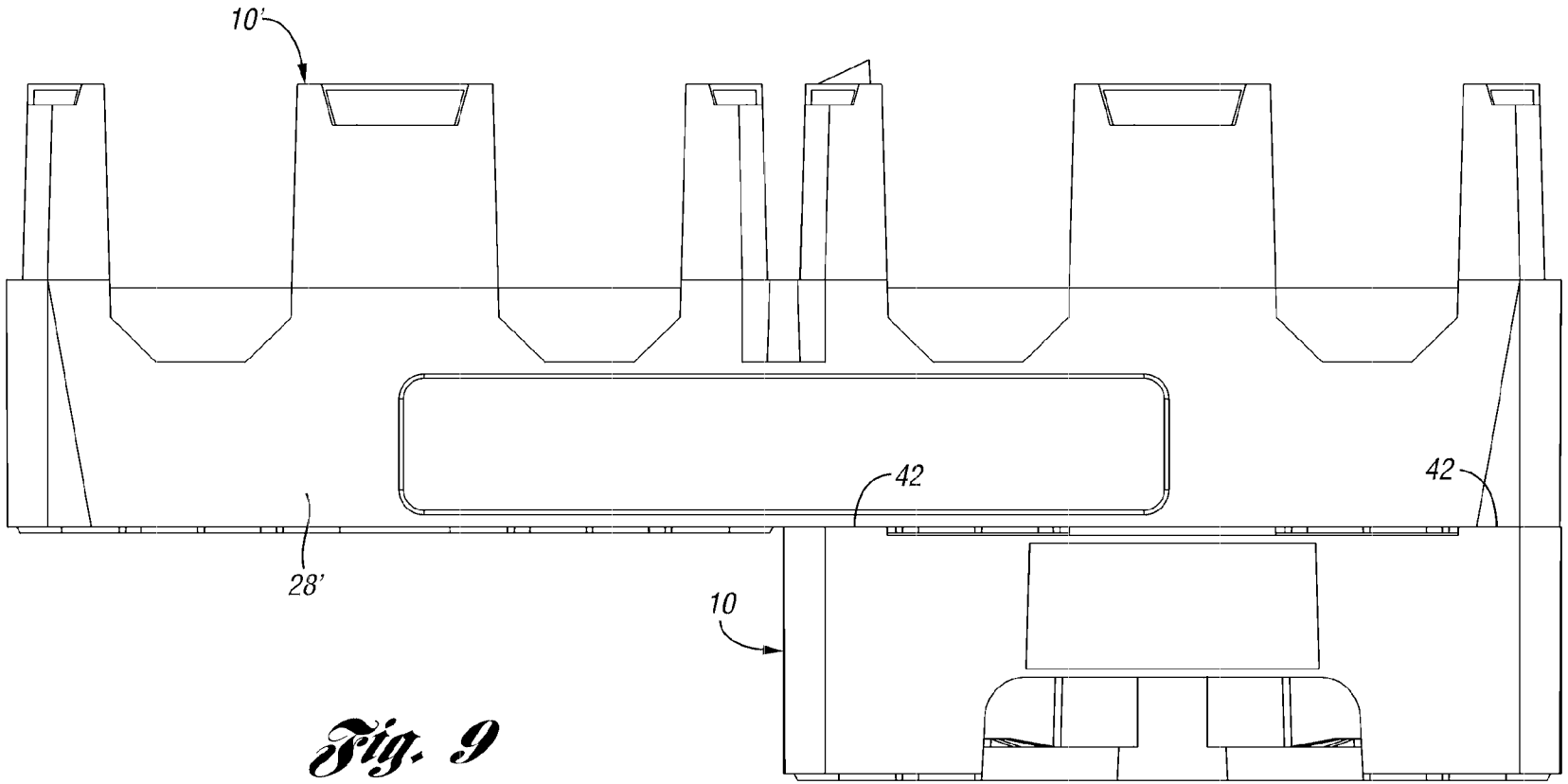
FIG. 9 is an end view of the trays of FIG. 8.
Figure 10:
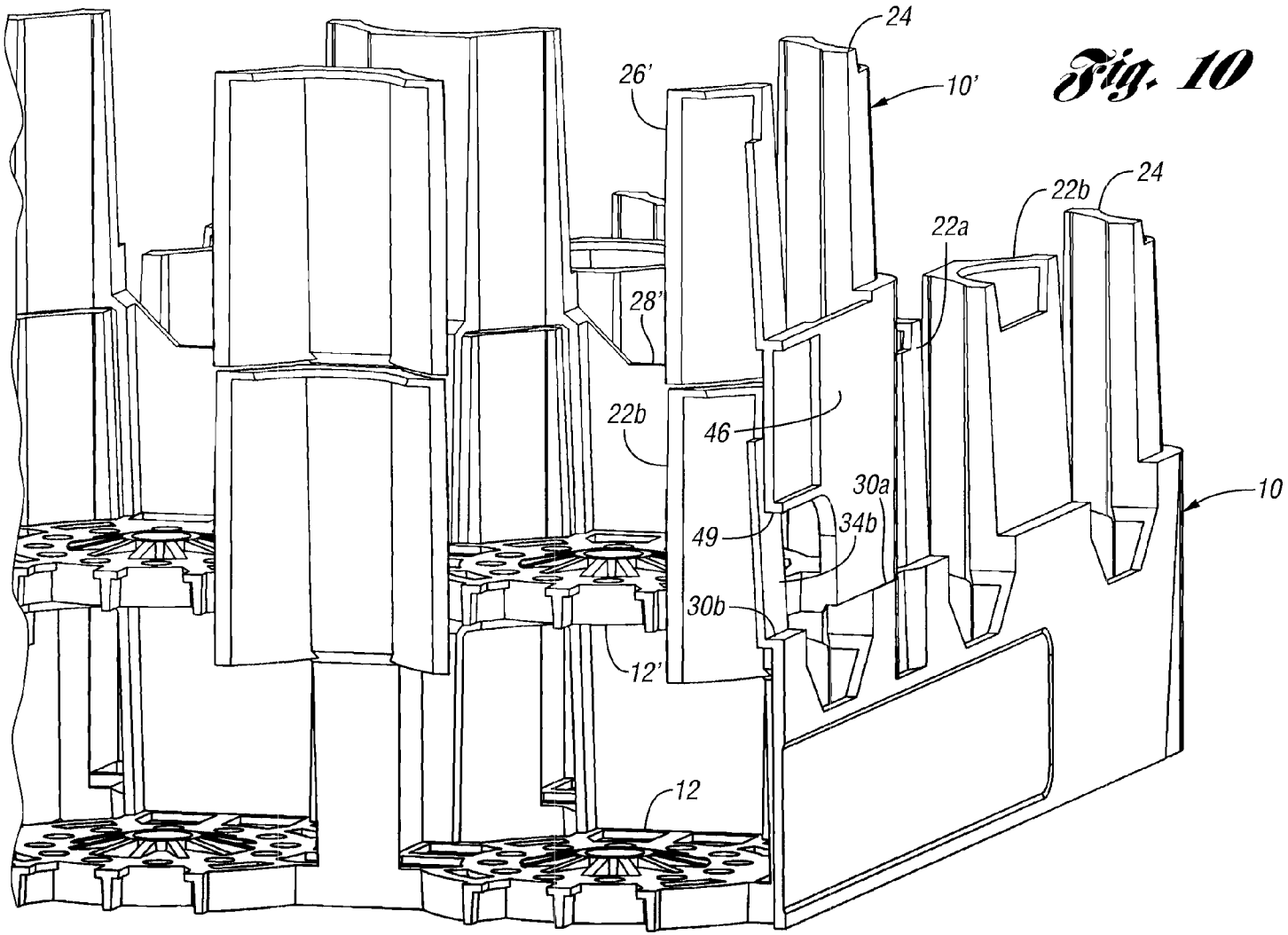
FIG. 10 is a section view through the trays of FIGS. 8 and 9.

FIG. 10 is a section view through a portion of the trays 10, 10' of FIGS. 8 and 9. Because the outer surface 34*b* of the noncenter side column 22*b* is offset inwardly, the noncenter side column 22*b* can nest behind the handle 49' of the upper tray 10'. The side wall 28' of the upper tray 10' is received within the passage 50 through the center side column 22*a*. The end wall 46' of the upper tray 10' rests on the outer ledge 30*a* of the center column 22*a* of the lower tray 10.

Figure 11:
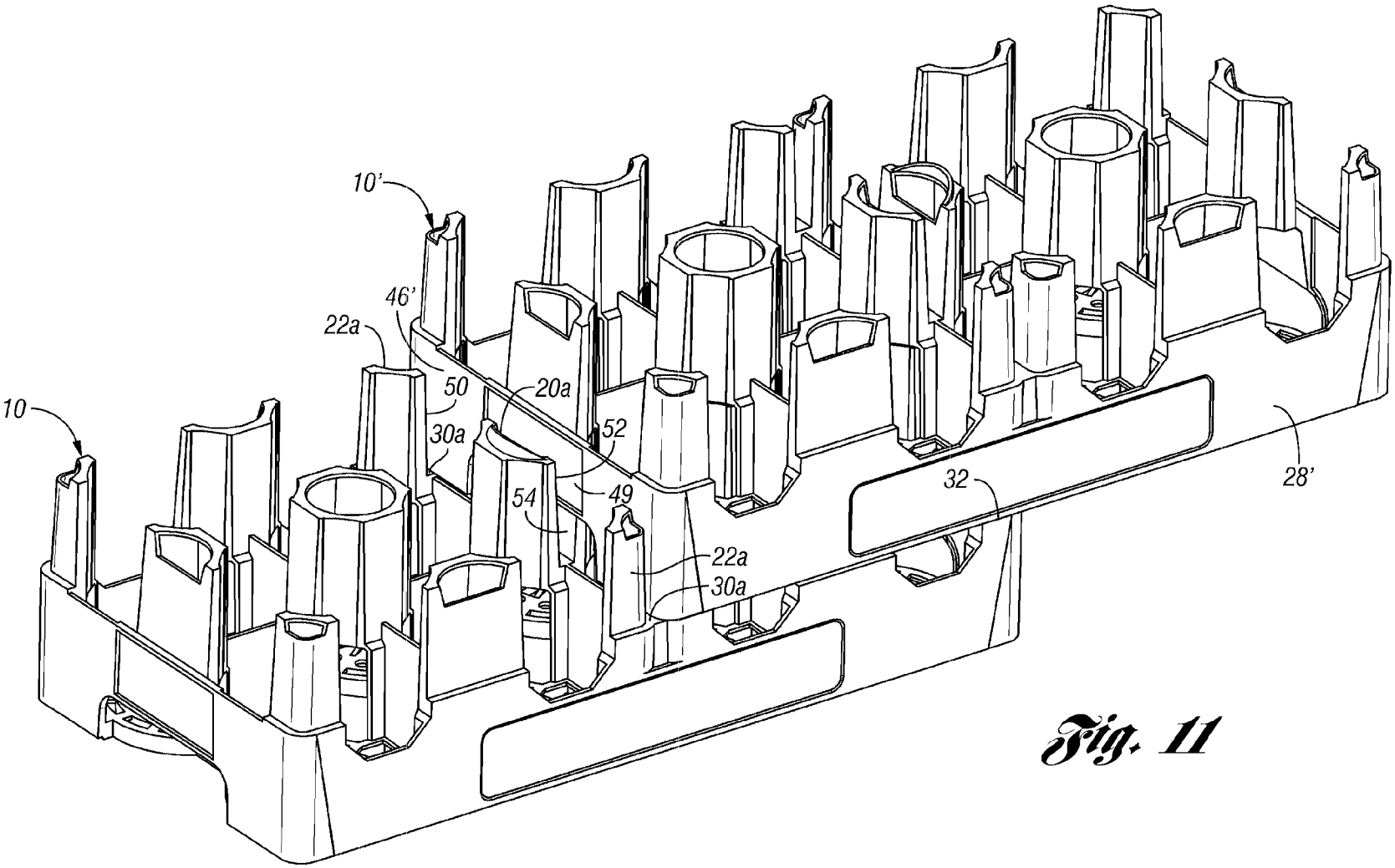
FIG. 11 shows the tray with the similar tray cross-stacked longitudinally thereon.

FIG. 11 shows the two trays 10, 10' in a longitudinally cross-stacked configuration. The end wall 46' of the upper tray 10' is received within the passages 50, 52 of the center side columns 22*a* and the center interior column 20*a* and rests on the outer ledges 30*a* of the center side columns 22*a*. The side walls 28' of the upper tray 10' rest on the outer ledges 32 of the lower tray 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray for storing and transporting bottles comprising:
a base for supporting bottles thereon;
a plurality of interior columns extending upwardly from the base, including a center interior column;
a plurality of side columns along sides of the tray, including two noncenter side columns and a center side column on each side of the tray, each center side column between the two noncenter side columns;
a plurality of corner columns at corners of the tray;
side walls extending along the sides of the tray; and
the center side columns and the corner columns having outer ledges defining a nesting height of the tray, such that the side walls of a similar tray nested thereon would contact and rest on the outer ledges of the center side columns and the corner columns, wherein the noncenter side columns do not include an outer ledge at the nesting height.

2. The tray of claim 1 further including a plurality of longitudinal dividers connecting the interior columns to one another.

3. The tray of claim 1 wherein the side walls are contiguous with the outer ledges.

4. The tray of claim 3 further including window openings between the center side column and the noncenter side columns, and wherein the side walls are lower below the window openings than at the outer ledges.

5. The tray of claim 1 wherein exterior surfaces at the nesting height of opposing noncenter side columns on opposite sides of the tray are spaced from one another by a distance less than that by which exterior surfaces at the nesting height of opposing center side columns on opposite sides of the tray.

6. The tray of claim 1 wherein the center interior column and the center side columns each include a first half and a second half spaced away from the first half, and wherein the center first half and second half of the center interior column are spaced away from one another by a distance greater than that of the first half and second half of each of the center side columns.

7. The tray of claim 6 wherein exterior surfaces at the nesting height of opposing noncenter side columns on opposite sides of the tray are spaced from one another by a distance less than that by which exterior surfaces at the nesting height of opposing center side columns on opposite sides of the tray.

8. A tray for storing and transporting bottles comprising:
a base for supporting bottles thereon;
a plurality of corner columns at corners of the tray;
a plurality of interior columns extending upwardly from the base, including a center interior column;
a plurality of side columns along sides of the tray, including two noncenter side columns and a center side column on each side of the tray, each center side column between the two noncenter side columns, exterior surfaces at a first height of opposing noncenter side columns on opposite sides of the tray are spaced from one another by a distance less than that by which are spaced exterior surfaces at the first height of opposing center side columns on opposite sides of the tray, wherein the center interior column and the center side columns each include a first half and a second half spaced away from the first half, and wherein the center first half and second half of the center interior column are spaced away from one another by a distance greater than that of the first half and second half of each of the center side columns.

9. The tray of claim 8 further including end columns at ends of the tray, each end column between two of the corner columns, exterior surfaces of the end columns offset inwardly relative to the respective adjacent corner columns.

10. A tray for storing and transporting bottles comprising:
a base for supporting bottles thereon;
a plurality of corner columns at corners of the tray;
a plurality of interior columns extending upwardly from the base, including a center interior column;
a plurality of side columns along sides of the tray, including two noncenter side columns and a center side column on each side of the tray, each center side column between the two noncenter side columns, exterior surfaces at a first height of opposing noncenter side columns on opposite sides of the tray are spaced from one another by a distance less than that by which are spaced exterior surface at the first height of opposing center side columns on opposite sides of the tray; and
end walls at opposite ends of the tray, each end wall including a recess opening downwardly to form a handle opening.

11. The tray of claim 10 further including end columns at ends of the tray, each end column between two of the corner columns, exterior surfaces of the end columns offset inwardly relative to the respective adjacent corner columns.

12. The tray of claim 11 wherein the end walls form outer ledges exterior of the corner columns and the end columns, wherein the ledges adjacent the corner columns are disposed in a common plane parallel to the base, and wherein the ledge adjacent the end column is offset downwardly from the common plane.

13. The tray of claim 12 wherein the end columns are arranged to extend upwardly higher than a lowermost edge of the handles of a similar tray nested thereon.

14. A tray for storing and transporting bottles comprising:
a base for supporting bottles thereon;
a plurality of corner columns at corners of the tray;
a plurality of interior columns extending upwardly from the base, including a center interior column;
a plurality of side columns along sides of the tray;
end columns at ends of the tray, each end column between two of the corner columns, exterior surfaces of the end columns offset inwardly relative to the respective adjacent corner columns; and
end walls at opposite ends of the tray, each end wall including a recess opening downwardly to form a handle opening below the end columns, wherein the end columns are arranged to extend upwardly higher than a lowermost edge of the handles of similar tray nested thereon.

15. The tray of claim 14 wherein the end walls form outer ledges exterior of the corner columns and the end columns, wherein the ledges adjacent the corner columns are disposed in a common plane parallel to the base, and wherein the ledge adjacent the end column is offset downwardly from the common plane.

16. A tray for storing and transporting bottles comprising:
a base for supporting bottles thereon;
a center side column on each side of the tray, the center side column including a first interior half and a second interior half spaced away from the first half;
a center interior column extending upwardly from the base, the center interior column including a first side half and a second side half spaced away from the first side half, the first interior half and second interior half of the center interior column are spaced away from one another by a distance greater than that of the first side half and second side half of each of the center side columns;
a plurality of corner columns at corners of the tray; and
side walls extending along the sides of the tray.

17. The tray of claim 16 further including noncenter side columns on each side of the tray, the center side columns between the noncenter side columns, wherein exterior surfaces of opposing noncenter side columns on opposite sides of the tray are spaced from one another by a distance less than that by which exterior surfaces of opposing center side columns on opposite sides of the tray.

18. The tray of claim 16 further including noncenter side columns on each side of the tray, the center side columns between the noncenter side columns, wherein the noncenter side columns are offset inwardly relative to adjacent center side columns and corner columns.

19. The tray of claim 16 wherein the center interior column includes a lower interior surface between the first interior half and the second interior half, and wherein the center side columns each include a lower side surface between the first side half and the second side half, the lower interior surface spaced below a plane containing the lower side surfaces.

* * * * *